US005997191A

United States Patent [19]

Verlinden et al.

[11] Patent Number: 5,997,191

[45] Date of Patent: Dec. 7, 1999

[54] MODULAR TREATMENT VESSEL FOR USE IN A PHOTOGRAPHIC MATERIAL PROCESSING APPARATUS

[75] Inventors: Bart Verlinden, Tongeren; Patrick Van den Bergen, Hove; Bart Verhoest, Wilriik, all of Belgium

[73] Assignee: Agfa-Gevaert, Mortsel, Belgium

[21] Appl. No.: 09/103,839

[22] Filed: Jun. 24, 1998

[30] Foreign Application Priority Data

Jul. 28, 1997 [EP] European Pat. Off. ..... 97202320

[51] Int. Cl.[6] ..... G03D 3/02; G03D 3/08; G03D 13/04

[52] U.S. Cl. ..... 396/612; 396/626; 396/636

[58] Field of Search ..... 396/626, 636, 396/641, 612, 620; 134/64 P, 122 P

[56] References Cited

U.S. PATENT DOCUMENTS 4,166,689 9/1979 Schausberger et al. .

4,987,438 1/1991 Goto et al. ..... 396/612

5,754,914 5/1998 Van Den Bergen et al. ..... 396/636

5,899,595 5/1999 Verlinden et al. ..... 396/626

FOREIGN PATENT DOCUMENTS 0744656 5/1995 European Pat. Off. .

*Primary Examiner*—D. Rutledge

*Attorney, Agent, or Firm*—Baker & Botts, L.L.P.

[57] ABSTRACT

A housing (10) defines a liquid treatment chamber (12). The chamber (12) has entrance and exit openings (16, 18) each closed by a pair of co-operating path defining rollers (20), rotatable about a horizontal axis (26) and in contact with each other to form a nip (22) through which a material transport path segment (24) extends. Sealing means (28) seal the path defining rollers (20) to the housing (10). A drip tray (30) is so shaped and positioned as to collect treatment liquid dripping from the roller (20), both when the material path segment (24) is vertical and when it is horizontal. The vessel may be connected in a closed manner to one or more further treatment vessels to constitute a apparatus for processing photographic material. The vessel can be successfully used in either orientation.

8 Claims, 3 Drawing Sheets

MODULAR TREATMENT VESSEL FOR USE IN A PHOTOGRAPHIC MATERIAL PROCESSING APPARATUS

FIELD OF THE INVENTION

This invention relates to a treatment vessel, in particular to a modular treatment vessel for use in a photographic material processing apparatus for the processing of photographic sheet material, such as X-ray film, pre-sensitised plates, graphic art film and paper, and offset plates. More particularly the invention relates to improvements in apparatus in which photographic material is transported through one or more treatment vessels.

BACKGROUND OF INVENTION

As a rule, a processing apparatus for photographic material comprises several vessels each of which contains a treatment liquid, such as a developer, a fixer and a rinse liquid. The photographic material may be in the form of cut sheets, or in the form of a web unwound from a roll. The sheet material to be processed is transported through these vessels in turn, by transport means such as one or more pairs of drive rollers, and thereafter optionally to a drying unit.

Apparatus for the processing of photographic sheet material such as aluminium lithographic printing plates is known, for example from U.S. Pat. No. 5,455,651 (Verhoest et al./Agfa-Gevaert NV), comprising a plurality of treatment vessels. Each vessel comprises a sheet material inlet and a sheet material outlet to define a substantially horizontal sheet material path through the apparatus. The inlet and outlet are each closed by a pair of rotatable rollers biased into contact with each other to form a nip there-between through which the sheet material path extends. The rollers are used to remove excess treatment liquid from the sheet as it passes from one treatment vessel to the next. This reduces carry-over of treatment liquid and thereby reduces contamination and wastage. A good removal of processing liquid is also required to reduce the drying time of the sheet material after the last wet process step, and hence to reduce the energy use.

It is desirable that the treatment liquid in one vessel is not contaminated by contents of the adjacent vessels, that is neither by the treatment liquid of an adjacent vessel nor by vapours escaping from one vessel to another. Furthermore, in order to reduce consumption of treatment liquids, it is desirable to reduce the evaporation, oxidation and carbonisation thereof.

It has therefore been proposed to provide sealing means to seal each roller to the housing. By providing a gas- and liquid-tight seal between the rollers on the one hand and a wall of the housing on the other, treatment liquid in one vessel is not contaminated by the contents of adjacent vessels.

It has also been proposed to provide drip trays so positioned as to collect treatment liquid which escapes between a roller and its associated sealing means and drips from the roller. By collecting such escaping treatment liquid, contamination of adjacent vessels thereby is avoided, and more efficient operation can be achieved by recycling this escaped liquid.

Traditionally, an apparatus for processing photographic material has a horizontal configuration, i.e. the material path through the apparatus is substantially horizontal. However, processing machines having a substantially vertical orientation have also been proposed, in which the vessels have an opening at the top acting as a sheet material inlet and an opening at the bottom acting as a sheet material outlet or vice versa. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus.

It would be desirable to be able to use the same apparatus, or parts of the same apparatus, for the processing of different photographic materials. Thus a modular construction is desirable, whereby at the choice of the user, a number of apparatus modules of differing function can be coupled together.

The choice between using a horizontal or a vertical apparatus is in part dependant upon the nature of the photographic material being processed and the opportunity for floor space reduction in integrated systems.

It would be advantageous for the user to be able to use one and the same apparatus module in both the vertical and horizontal configurations, substantially without significant modification. However, the modular constructions which have been proposed to date are suitable for use only in one orientation. It would also be desirable to enable a processing apparatus to be connectable to ancillary upstream or downstream equipment, such as laser recorders of various designs in order to best comply with the orientation demands of the integrated system so formed. In this connection, reference may be made to European patent application EP 0 744 652 (Agfa-Gevaert NV) which is concerned with an integrated apparatus in which an imaging element is fed automatically from an exposing part of the apparatus to a vertically oriented processing part.

OBJECTS OF INVENTION

It is an object of the present invention to provide a treatment vessel which can be used both in the vertical and horizontal configurations, without significant modification.

SUMMARY OF THE INVENTION

We have discovered that this objective and other useful advantages can be obtained when the drip tray is so shaped and positioned as to collect treatment liquid dripping from the roller both when the material path segment is vertical and when the material path segment is horizontal.

According to the invention, there is provided a treatment vessel comprising a housing defining a liquid treatment chamber, means for connecting the vessel in a closed manner to one or more further treatment vessels thereby to constitute a processing apparatus for processing photographic material, the chamber having an entrance opening and an exit opening each closed by a pair of co-operating path defining rollers in contact with each other to form a nip there-between through which a material transport path segment extends, each roller being rotatable about a horizontal axis and being associated with sealing means for sealing the roller to the housing, and a drip tray positioned to collect treatment liquid dripping from the roller, characterised in that the drip tray is so shaped and positioned as to collect treatment liquid, which escapes between the roller and its associated sealing means and drips from the roller, both when the material path segment is vertical and when the material path segment is horizontal.

Typical path defining rollers have a core provided with a covering of elastomeric material, although it is possible for the roller to be elastomeric throughout its cross-section. According to a preferred embodiment each roller comprises a rigid core carrying a covering of elastomeric material, the ratio ($\phi$/L) of the maximum diameter ($\phi$) of the elastomeric material covering to the overall length (L) thereof being at least 0.012, most preferably between 0.03 and 0.06. The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment of the invention, the diameter ($\phi$) of the elastomeric material covering is constant along the length of the roller. Alternatively the roller may have a radial dimension profile which varies along the length thereof. In the latter case, the diameter ($\phi$) in the expression $\phi$/L is the maximum diameter. In a preferred embodiment, such a roller comprises a non-deformable core, the thickness of the elastomeric material covering varying along the length thereof. Alternatively or additionally, the diameter of the core varies along the length thereof.

Preferably, the core has a flexural E-modulus of between 50 GPa and 300 GPA. Suitable materials for the rigid core include metals, such as stainless steel, non-ferrous alloys, titanium, aluminium or a composite thereof or a composite material of fibres such as carbon fibres and a resin matrix.

In one embodiment of the invention, the core is hollow, in order to reduce the weight thereof. Alternatively the core may be solid, thereby to improve the strength thereof.

The path defining rollers of each pair may be biased together by a variety of methods. The path defining rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

The path-defining rollers may have a closed position in which the path-defining rollers are biased into contact with each other to form the nip through which the sheet material path extends, and an open position in which the path-defining rollers are spaced from each other. The path-defining rollers can be separated from one another, for the purposes of cleaning the apparatus, by a simple and convenient construction in which the path defining rollers are supported by bearings carried by eccentric sleeves which are stationary in the closed position. Means may be provided for partly rotating the sleeves thereby to withdraw the path-defining rollers from each other into the open position.

Means are provided for connecting the vessel in a closed manner to one or more further treatment vessels thereby to constitute an apparatus for processing photographic material. It is desirable that vessels are connected together in such a manner that the material path segment of one vessel is co-planar with the material path segment of the next vessel. This arrangement enables the material path through the apparatus to be substantially straight. A straight path is independent of the stiffness of the photographic material and reduces the risk of scratching compared with a circuitous path.

It is important to connect each vessel to adjacent vessels in the apparatus in a closed manner. By the term "closed manner" in this specification is meant that each vessel is so connected to adjacent vessels that no vessel is open to the environment. By connecting vessels together in this manner, the evaporation, oxidation and carbonisation of treatment liquids can be significantly reduced.

Usually each vessel of the apparatus is constructed as aforesaid. However, some vessels may be of different construction, adapted for example as cells in which no liquid immersion treatment of the photographic material takes place. Such alternative vessels may include means for spraying a treatment liquid directly on to the photographic material or may simply constitute intermediate buffer cells where diffusion reactions take place on the photographic material prior to contact with treatment liquid in the next adjacent vessel. The vessels may also include additional features if desired. Cleaning means may be provided for acting upon the path defining rollers to remove debris therefrom, as described in European patent application EP 0 647 882 (Agfa-Gevaert NV).

Additional rollers, such as a roller pair or staggered rollers may be provided for transporting the photographic material through the apparatus, and these rollers will normally be driven rollers. Additional roller pairs may be provided for breaking the laminar fluid at the surface of the photographic material as it passes through the apparatus, and these rollers may be driven rollers or freely rotating rollers. Guide means may be included for guiding the passage of the photographic material through the apparatus. While liquid pumping, heating, cooling and filtering facilities will normally be provided outside the vessels, it is possible for some elements of these features to be included in the vessels themselves. Any combination of these additional features is also possible.

Each drip tray is preferably so shaped and positioned as to collect treatment liquid dripping from the associated roller irrespective of the orientation of the vessel.

In one embodiment of the invention, each drip tray is formed by a continuous wall partially surrounding the associated roller. Preferably the continuous drip tray wall terminates with a lip adjacent the material path. The continuous wall may be provided with one or more drain holes.

Each drip tray may constitute a collecting chamber which is preferably a closed chamber and means may be provided to return treatment liquid from the collecting chamber to the treatment vessel. This construction has the advantage that the wastage of treatment liquid is reduced without requiring the use of complicated and costly sealing devices.

The sealing means may be constituted by fixed sealing members, but we prefer the use of sealing rollers, as described in European patent application 95203465.0 filed Dec. 13, 1995. Where the sealing means is a fixed sealing member, it preferably makes contact with its associated roller at an angle of less than 180°, such as between 45° and 135° from the nip on the liquid side. This arrangement enables the path defining rollers away to be moved away from each other, and from the sealing means and also helps to ensure that leakage between the roller and its associated sealing means reliably drips into the drip tray. Thus the apparatus may further comprise means for selectively moving the path defining rollers away from each other to enable the cell to be more easily cleaned and to remove the necessity for the path defining rollers to remain in contact with each other when the apparatus is idle. The lip of the drip tray is preferably diametrically opposite to the sealing means contact, or between such a point and the material transport path segment.

The fixed sealing member may be a sealing strip in contact with the rotatable roller along its length. The sealing member may contact the associated roller along a straight line parallel to the associated roller axis. The sealing member preferably exerts a spring force of between 2 and 500 g/cm of roller, perpendicular to the roller surface. The spring loading may be derived from the geometry of a sealing member, from a separate spring incorporated in a sealing member or simply from compression of the elastomeric material covering of the associated roller.

However, by the use of a rotatable sealing member in place of a fixed sealing member, the torque which needs to be applied to the path-defining roller can be significantly reduced. This reduces the power needed by the processor, reduces wear on the path-defining roller, reduces the mechanical deformation thereof and thereby extends the expected life time. This construction also improves the control of pressure distribution over the sheet material.

The rotatable sealing member preferably comprises a sealing roller, and in particular the sealing roller may have a diameter less than that of the path-defining roller. For example, the sealing roller may have a diameter which is from one tenth to one third of the diameter of the path-defining roller, thereby enabling the torque which needs to be applied to be further reduced. The sealing roller preferably extends in a straight line parallel to the associated path-defining roller axis and preferably contacts the surface of the associated path-defining roller at a location which is between 45° and 315°, most preferably between 80° and 100° from the centre of the nip, on the fluid side.

The sealing roller may be formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni—PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the vessel. The longitudinal bearing may have face-to-face contact with the sealing roller over at least two contact regions, which are located, for example, at from ±120° to 150° relative to the line joining the centres of a path-defining roller and its associated sealing roller, such as ±135° to that line. The width of contact between a sealing roller and its associated longitudinal bearing in each contact region is, for example, from 20° to 40° of the circumference of the sealing roller, which in the case of a sealing roller having a diameter of 8 mm may be about 2 mm per contact region.

The surface of the sealing roller opposite to the path-defining roller may be in contact with one or more stationary sealing members carried in, or formed as part of, the longitudinal bearing. The stationary sealing member may, for example, be retained within a longitudinal groove formed in the longitudinal bearing. The stationary sealing member may have a symmetrical profile section but a non-symmetrical profile section is also possible, its shape and resilience taking into account the hydrostatic and hydrodynamic pressures in the vessel and the interacting forces with the sealing roller, allowing for the fact that the path-defining roller and the sealing roller may be adapted to rotate in both directions.

The ends of the sealing roller may be in contact in a leak-free manner with stationary bodies, such as an end plate secured to, or located in a fixed position relative to, the housing of the apparatus. For example, the end of the sealing roller passes into a blind aperture in the end plate. In an alternative embodiment, the end of the sealing roller is located in an open aperture in the end plate, this aperture being provided with a sealing ring, or other sealing member, formed for example of sintered PTFE, to prevent leakage therethrough.

It is important that the sealing rollers are retained in these end plates in a leak-free manner. A line contact between the sealing rollers and the end plates is preferred to a surface-to-surface contact. In one embodiment, the sealing ring surrounds the end of the sealing roller and is urged into line-to-surface sealing engagement with the surface of the sealing roller by a spring. We have found that line contact between the sealing roller and the end plates need not extend circumferentially completely around the sealing roller, and indeed there is an advantage in this line contact extending only part way around the sealing roller, but on the liquid side thereof. This construction makes the tolerances to which the sealing roller and the end plates are constructed less critical. It is preferred to use a sealing ring which is so constructed as to compensate for the wear thereof. This can be achieved by forming the sealing ring with a frusto-conical inner surface and by the provision of a spring force which acts in a direction to feed sealing material towards the wear surface. We prefer to use a material for the sealing ring which has good "creeping" characteristics to compensate for the wear under spring pressure, such as sintered PTFE.

In an alternative embodiment, end portions of the sealing roller are formed of an elastomeric material, such as natural or synthetic rubber, and these end portions press against the end plates in a leak-free manner.

The stationary sealing member which is carried in, or formed as part of, the longitudinal bearing preferably exerts a pressure on the sealing roller which is also at least $\rho*g*h$, most preferably at least 2 $\rho*g*h$. To reduce friction at this point, the contact surface between the stationary sealing member and the sealing roller is kept to a minimum. It is also desirable to establish a sealing pressure between the path-defining roller and the sealing roller. While this should preferably also exceed $\rho*g*h$ and most preferably 2 $\rho*g*h$, the absolute force applied by the path-defining roller to the sealing roller should be greater than the absolute force exerted by the stationary sealing member on the sealing roller to ensure that the sealing roller touches the bearing surfaces of the longitudinal bearing. This enables the absolute force exerted by the sealing roller on the bearing surfaces to be reduced to a minimum thereby reducing the friction at this point. The pressure exerted by the path-defining roller on the sealing roller may be derived from the mounting of the sealing roller or simply from compression of the elastomeric material covering of the associated path-defining roller or from spring forces exerted on the path-defining roller.

It is preferred that the end faces of the sealing roller and stationary sealing member extend beyond the end faces of the elastomeric part of the path-defining roller. In this way the sealing function is less dependant on tolerances and differential thermal expansion of these components and their thermal expansion relative to the path-defining roller, more precisely between the end faces of the path-defining roller. That is, it is preferred that the stationary sealing member is longer than the associated path-defining roller, and further that the contact surfaces of the longitudinal bearing with the sealing roller are shorter than the associated path-defining roller.

Preferably, at least one of the path defining rollers constitutes a drive roller for driving the sheet material along the sheet material path. Constituting the roller as a drive roller enables the cell to be constituted in a particularly simple manner. Alternatively, the path defining rollers may be freely rotating, alternative drive means being provided to drive the photographic sheet material through the apparatus.

The housing may define at least two passages opening into the chamber, to constitute liquid inlet and liquid outlet passages. Where adjacent vessels in an apparatus use the same treatment liquid, for example as in a cascade, the outlet passage of one vessel may be connected directly to the input passage of the adjacent vessel. Otherwise, the inlet passage will be connected to a supply of the treatment liquid, and the outlet passage will be connected to a discharge facility or to a circulation loop. Thus, means such as a pump, may be provided to circulate the treatment liquids through the treatment vessels.

The processing method may include causing processing liquid to pass across the surface of the photographic sheet material in such a manner that the speed of liquid flow across the sheet material, as measured in a direction perpendicular to the direction of the sheet material path, is at least 3 times the speed of the sheet material along the sheet material path and the resultant liquid flow speed is at least 100 mm/sec. By the use of these features, the consistency of reaction kinetics at the sheet material surface are improved.

Alternatively, the method comprises bringing the processing liquid into the vicinity of the sheet material in a direction generally normal to the surface thereof and removing the liquid from the vicinity of said sheet material in an opposite direction. More uniform processing of photographic sheet material can thereby be achieved.

After passing through the treatment liquids, the photographic material is dried in a drying cell.

The apparatus and method described herein can be used to process a number of different types of photographic material, including for example X-ray film, one- and two-sheet DTR photographic materials, lithographic plates and graphic arts photographic materials, the details of the apparatus being modified as desired according to the intended use.

DETAILED DESCRIPTION OF THE INVENTION

The invention will be described by the following illustrative embodiments with reference to the accompanying drawings without the intention to limit the invention thereto, and in which.

Figure 1:
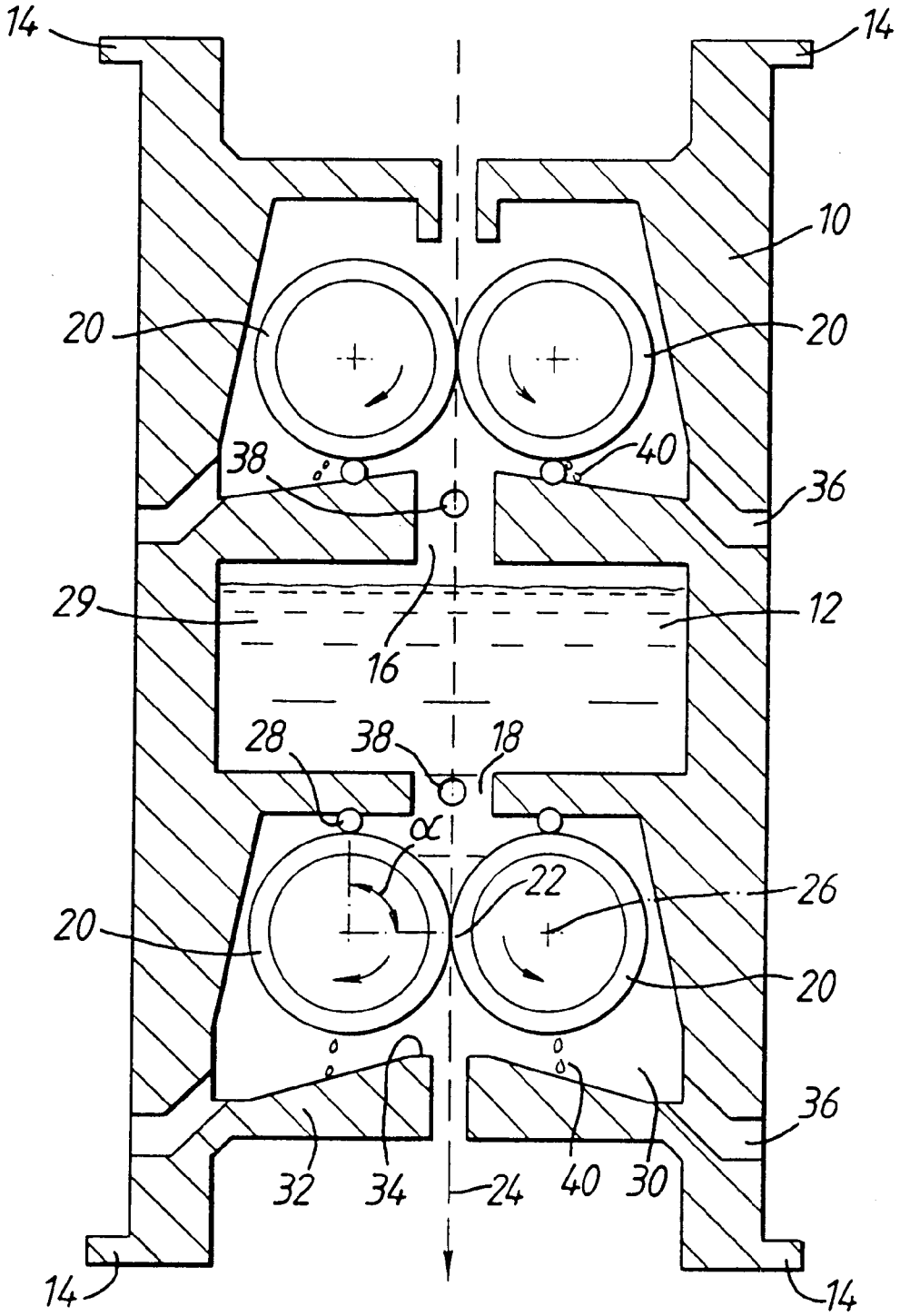
FIG. 1 shows, in cross-section, a treatment vessel according to the invention, used in a vertical configuration.
Figure 2:
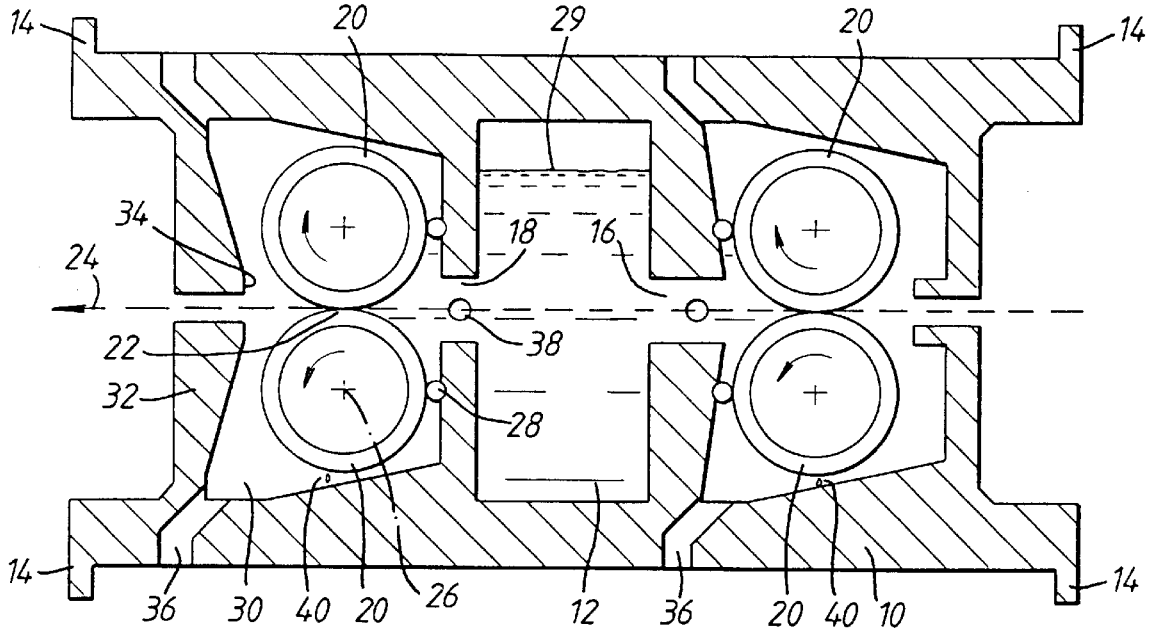
FIG. 2 shows, in cross-section, the same treatment vessel used in a horizontal configuration.
Figure 3:
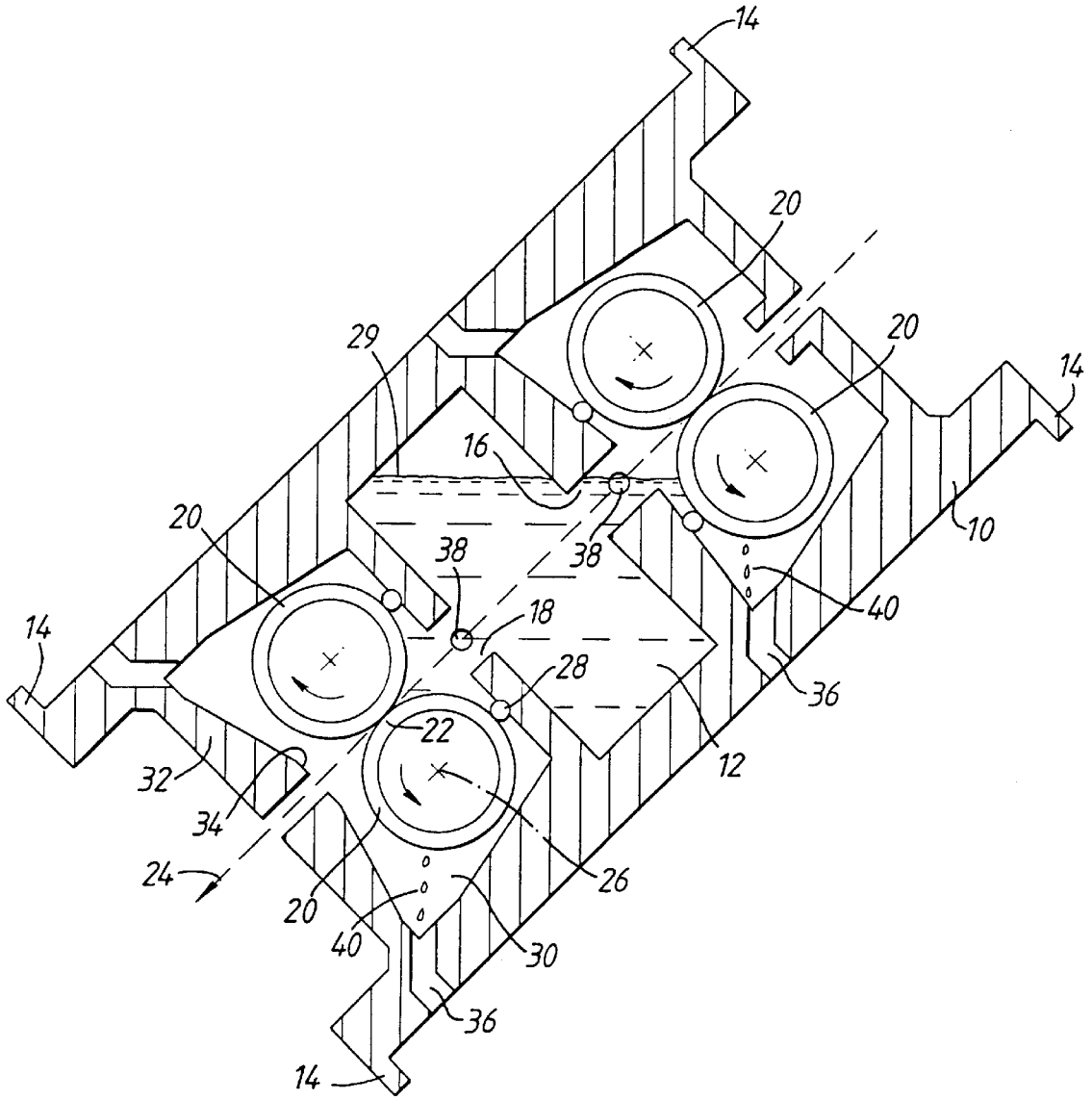
FIG. 3 shows, in cross-section, the same treatment vessel used in an inclined configuration.

As shown in FIGS. 1, 2 and 3, a treatment vessel comprises a housing 10, the walls of which define a liquid treatment chamber 12. Flanges 14 are provided for connecting the vessel in a closed manner to one or more further treatment vessels thereby to constitute a processing apparatus for processing photographic material.

The chamber 12 has an entrance opening 16 and an exit opening 18 each closed by a pair of co-operating path defining rollers 20. The path defining rollers 20 of each pair are in contact with each other to form a nip 22 there-between through which a segment of the material transport path 24 extends.

Each roller 20 is rotatable about a horizontal axis 26 and is in contact along its length with a sealing roller 28 for sealing the roller 20 to the housing 10. The sealing roller 28 makes contact with its associated roller 20 at an angle $\alpha$ of about 90° from the nip 22 on the fluid side. The chamber 12 contain treatment liquid 29 which, in use, tends to leak between each roller 20 and its associated sealing roller 28. This leaking liquid drips from the lower extremity of each roller 20 as shown.

Each roller 20 is associated with a drip tray 30, positioned to collect any treatment liquid dripping from the roller 20, not only when the vessel is used in its vertical configuration as shown in FIG. 1, but also when used in its horizontal configuration as shown in FIG. 2. The drip tray 30 is formed by a continuous wall 32 partially surrounding the associated roller 20. The continuous drip tray wall 32 terminates with a lip 34 adjacent the material path 24, which lip helps to retain liquid which collects in the drip tray, whatever the orientation of the vessel. Thus, the drip tray 30 is so shaped and positioned as to collect treatment liquid dripping from the roller 20 even when the vessel is used in a configuration between the vertical and the horizontal, i.e. in an inclined configuration.

In each of the Figures, liquid leaking between a roller 20 and its associated sealing roller 28 is indicated at 40, and by comparison between the Figures it will be seen that, whatever the orientation of the apparatus, this leaking liquid drips into a drip tray 30. The continuous walls 32 are each provided with a drain hole 36, from which the collected liquid can be removed, to be discarded or re-cycled as desired.

The end walls of the housing 10 are provided with two passages 38 opening into the chamber, to constitute liquid inlet and liquid outlet passages.

In use, a number of vessels will be coupled together, by way of the flanges 14 and suitable coupling devices, to form a processing apparatus having the desired configuration. The path defining rollers 20 and associated sealing means 28 seal the entrances and exits of the treatment vessels and prevent the contents of one treatment vessel from contaminating the contents of an adjacent treatment vessel. This is particularly important where a vessel containing fixer liquid is positioned adjacent a vessel containing developer liquid. At the entrance and exit of the apparatus, additional pairs of co-operating path defining rollers may be provided if desired, to reduce the evaporation of liquid from the first and last drip trays.

Figure 4:
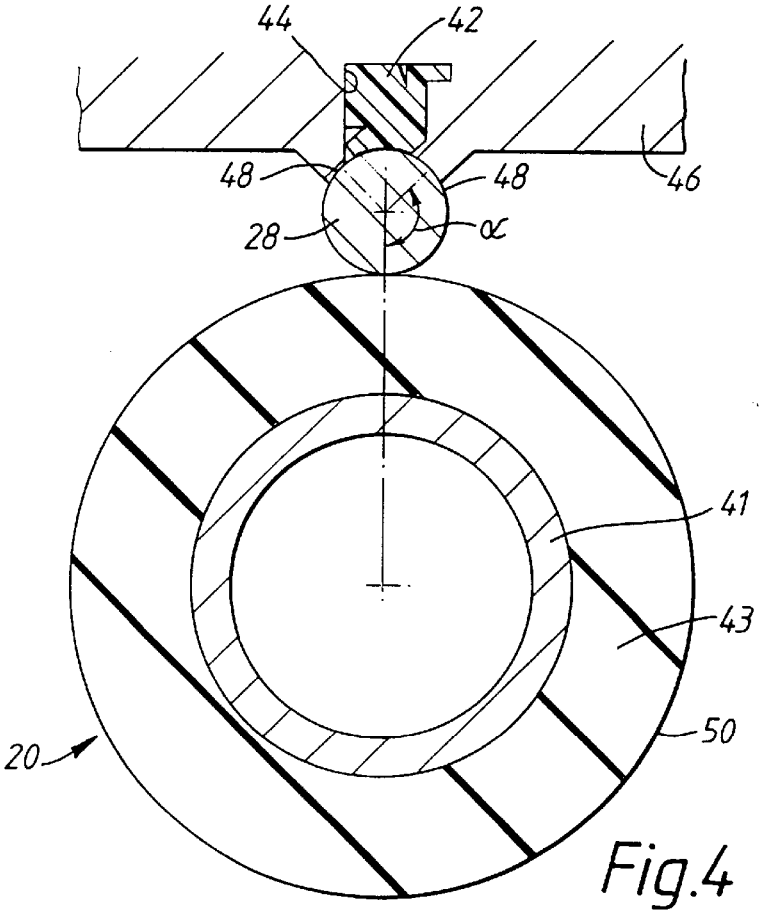
FIG. 4 shows, in cross-section details of the sealing of the path-defining rollers of the vessel shown in FIGS. 1, 2 and 3.

Referring to FIG. 4 each path-defining roller 20 comprises a core 41 provided with a covering 43 of elastomeric material which is in sealing contact along its length, with a respective rotatable sealing roller 28 formed for example of hardened or PTFE-coated metal carried by a longitudinal bearing 46, formed, for example, of high density polyethylene. The longitudinal bearing 46 is in face-to-face contact with the sealing roller over two contact regions 48, which are positioned one on either side of a groove 44 extending along the length of the longitudinal bearing 46, the contact regions 48 being located at an angle $\alpha$ of ±135° relative to the line joining the centres of a path-defining roller 20 and the sealing roller 28. The longitudinal bearing 46 is secured to the housing 10 of the vessel, the treatment liquid 29 being retained in the vessel by the path-defining rollers 20 and the sealing rollers 28. The sealing roller 28 contacts the surface 50 of the first path-defining roller 20 at a location which, in this particular embodiment, is about 90° from the centre of the nip 22 on the fluid side, that is from the plane joining the axes of rotation of the path-defining rollers 20. The benefit of this arrangement is that the sealing force on the path-defining roller does not influence the bias forces between the rollers, or only influence these forces to a limited extent.

The path-defining roller 20 is in contact with the sealing roller 28 along the length thereof. The upper surface of the sealing roller 28 is in contact with a stationary sealing member 42 in strip form, which is a pressure fit in the groove 44 of the longitudinal bearing 46 or alternatively is secured therein by means of a water- and chemical-proof adhesive, and extends lengthwise beyond the ends of the sealing roller 28.

The sealing member 42 is, for example, an extruded profile of Santoprene, an extrusion of various different grades of Santoprene or an extrusion of Santoprene with polypropylene. In all these cases, the Santoprene may be foamed or unfoamed. The Santoprene may be replaced by EPDM. The polypropylene may be replaced by polybutylterephthalate (PBT). A sealing member which is a co-extrusion of EPDM with PBT is also possible. Fillers may be included in the sealing material. The sealing member should have good chemical resistance and durability.

In an alternative embodiment, the sealing member 42 is co-extruded with the longitudinal bearing 46, especially if formed of polyethylene or polypropylene.

REFERENCE NUMBER LIST

| | |
|---|---|
| housing 10 | drip tray 30 |
| chamber 12 | continuous wall 32 |
| Flanges 14 | lip 34 |
| entrance opening 16 | drain hole 36 |
| exit opening 18 | passages 38 |
| path defining rollers 20 | drips 40 |
| nip 22 | core 41 |
| material transport path 24 | stationary sealing member 42 |
| horizontal axis 26 | covering 43 |
| sealing roller 28 | groove 44 |
| treatment liquid 29 | longitudinal bearing 46 |
| angle α | contact regions 48 |
| | surface 50 |

We claim:

1. A treatment vessel comprising a housing (10) defining a liquid treatment chamber (12), means (14) for connecting said vessel in a closed manner to one or more further treatment vessels thereby to constitute a processing apparatus for processing photographic material, said chamber (12) having an entrance opening (16) and an exit opening (18) each closed by a pair of co-operating path defining rollers (20) in contact with each other to form a nip (22) therebetween through which a material transport path segment (24) extends, each said roller (20) being rotatable about a horizontal axis (26) and being associated with sealing means (28) for sealing said roller (20) to said housing (10), and a drip tray (30) positioned to collect treatment liquid dripping from said roller (20), characterised in that said drip tray (30) is so shaped and positioned as to collect treatment liquid, which escapes between said roller (20) and its associated sealing means (28) and drips from said roller (20), both when said material path segment (24) is vertical and when said material path segment (24) is horizontal.

2. A vessel according to claim 1, wherein each said drip tray (30) is so shaped and positioned as to collect treatment liquid dripping from the associated roller (20) irrespective of the orientation of said vessel.

3. A vessel according to claim 1, wherein each said drip tray (30) is formed by a continuous wall (32) partially surrounding the associated roller (20).

4. A vessel according to claim 3, wherein said continuous drip tray wall (32) terminates with a lip (34) adjacent said material path.

5. A vessel according to claim 3, wherein said continuous wall (32) is provided with one or more drain holes (36).

6. A vessel according to claim 1, wherein said sealing means (28) makes contact with its associated roller (20) at an angle (α) of less than 180°, such as between 45° and 135° from the nip (22) on the fluid side.

7. A vessel according to claim 1, wherein said sealing means (28) is constituted by a sealing roller.

8. A vessel according to claim 1, wherein said housing (10) defines at least two passages (38) opening into said chamber, to constitute liquid inlet and liquid outlet passages.

* * * * *